US005488841A

United States Patent [19]

Wang

[11] Patent Number: 5,488,841

[45] Date of Patent: Feb. 6, 1996

[54] STRUCTURE OF SELECTING MECHANISM FOR CIRCULAR KNITTING MACHINES

[75] Inventor: Ping-Shin Wang, Taipei, Taiwan

[73] Assignee: Pai Lung Machinery Mill Co., Ltd., Taipei, Taiwan

[21] Appl. No.: 416,978

[22] Filed: Apr. 5, 1995

[51] Int. Cl.[6] ..... D04B 9/26; D04B 15/66

[52] U.S. Cl. ..... 66/220; 66/219

[58] Field of Search ..... 66/215, 216, 217, 66/218, 219, 220

[56] References Cited

U.S. PATENT DOCUMENTS

| | | | |
|---|---|---|---|
| 4,138,865 | 2/1979 | Lüth | 66/219 |
| 4,515,186 | 5/1985 | Durville et al. | 66/219 X |
| 4,860,557 | 8/1989 | Güell | 66/219 X |
| 5,000,014 | 3/1991 | Tenconi | 66/219 |

*Primary Examiner*—John J. Calvert
*Attorney, Agent, or Firm*—Bacon & Thomas

[57] ABSTRACT

A selecting mechanism for a circular knitting machine, including a hollow base, which holds pairs of selecting jacks at different elevations, and a selecting jack pushing-up device detachably fastened to the hollow base to hold pairs of pushing-up plates, wherein each pushing-up plate has a nose turned about a respective pivot between two alternative positions for controlling the positions of the pairs of selecting jacks for a full-stitch, half-stitch, or plain-stitch operation.

1 Claim, 7 Drawing Sheets

STRUCTURE OF SELECTING MECHANISM FOR CIRCULAR KNITTING MACHINES

BACKGROUND OF THE INVENTION

The present invention relates to a selecting mechanism for circular knitting machines which can be conveniently set into the desired arrangement for controlling the full-stitch, half-stitch, and plain-stitch operations of the needles.

Using a selecting mechanism to selectively push up the needles or sinkers for a patterned knitting is well known. There are known six different types of selecting mechanisms for this purpose, namely, the Fancy cams, the pattern wheels, the pattern blades, the pattern drums (see British Pat. Nos. 572,908; 709,209), the pattern tapes, and the jacquard rollers. The pattern blades type is now more and more popularly accepted because it is compact and less inexpensive and it needs less installation space. Furthermore, the selecting jacks can be arranged wither individually or by pairs. When pairs of selecting jacks are installed, full-stitch, half-stitch, and plain-stitch operations are selectable. FIG. 1 shows a regular pattern blades type selecting mechanism in which the selecting jacks are movably mounted within the hollow base by two axles. When to change the positions of the selecting jacks, a special hand tool is needed. Because a circular knitting machine has as much as 36 sets of selection mechanisms, it is difficult and time-consuming to change the positions of the selecting jacks.

SUMMARY OF THE INVENTION

The present invention has been accomplished to eliminate the aforesaid problems. According to one aspect of the present invention, the selecting mechanism comprises a hollow base, which holds pairs of selecting jacks at different elevations, and a selecting jack pushing-up device detachably fastened to the hollow base by screw bolts to hold pairs of pushing-up plates. When to change the positions of the pushing-up plates, the selecting jack pushing-up device can be detached from the base. According to another aspect of the present invention, each pushing-up plate has a nose turned about a respective pivot between two alternative positions for controlling the positions of the pairs of selecting jacks for a full-stitch, half-stitch, or plain-stitch operation. Therefore, adjusting the positions of the push-up plates can be made by fingers without the use of any hand tools.

DETAILED DESCRIPTION OF THE PREFERRED EMBODIMENT

Figure 1:
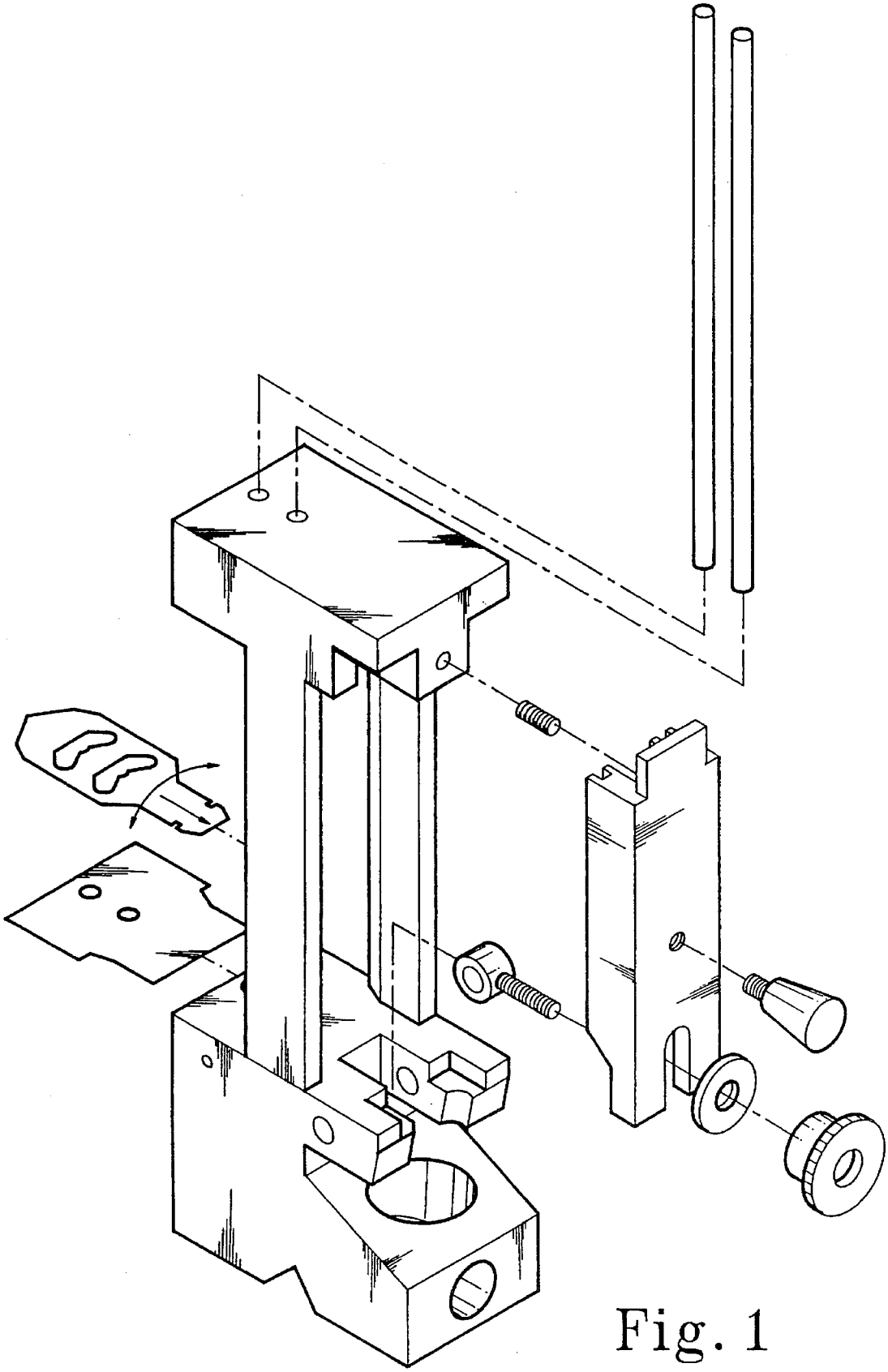
Fig. 1 PRIOR ART
FIG. 1 is an exploded view of a pattern blades type selecting mechanism according to the prior art.
Figure 2:
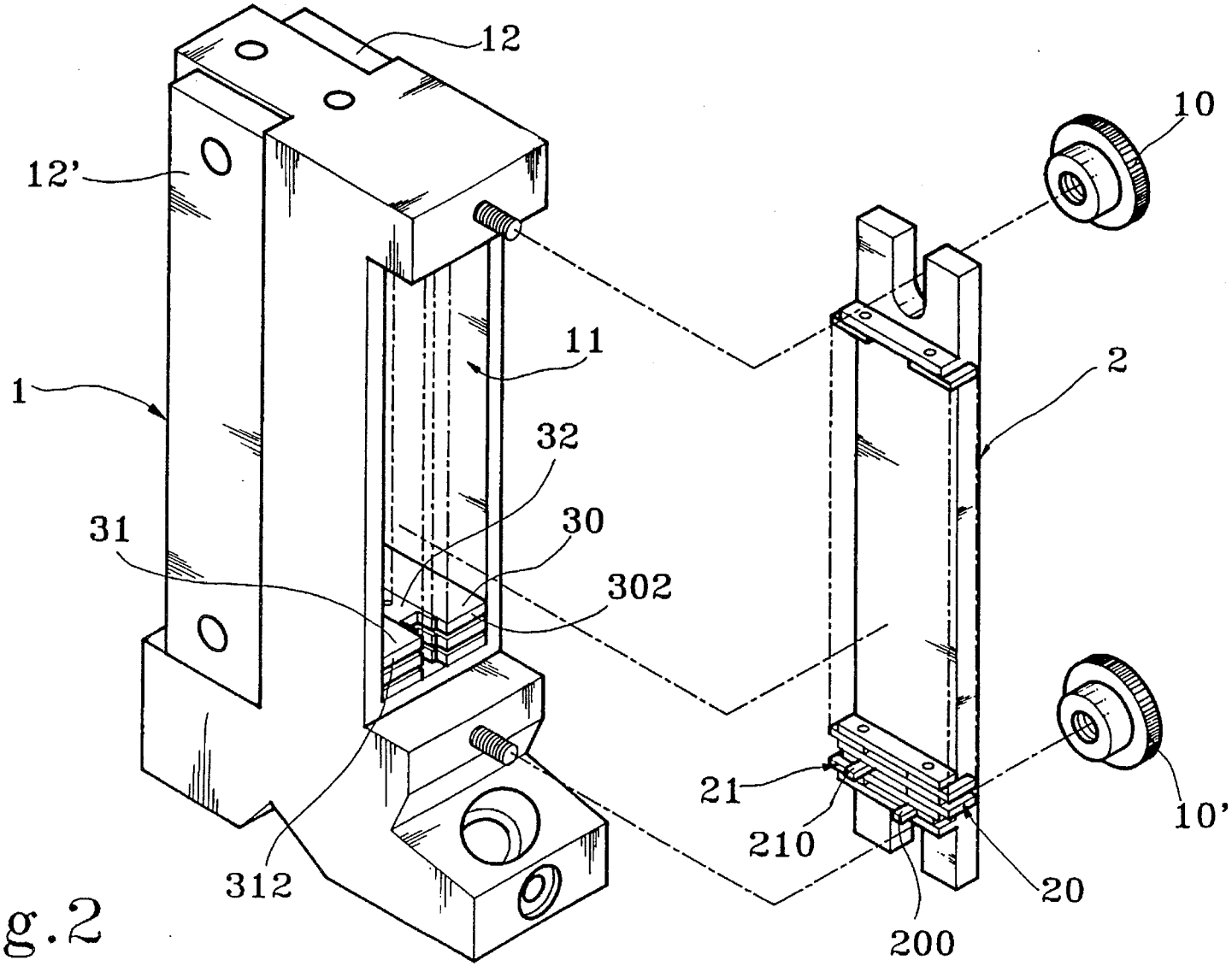
FIG. 2 is a dismantled view of a selecting mechanism according to the present invention, showing the selecting jack pushing-up device separated from the base.
Figure 7:
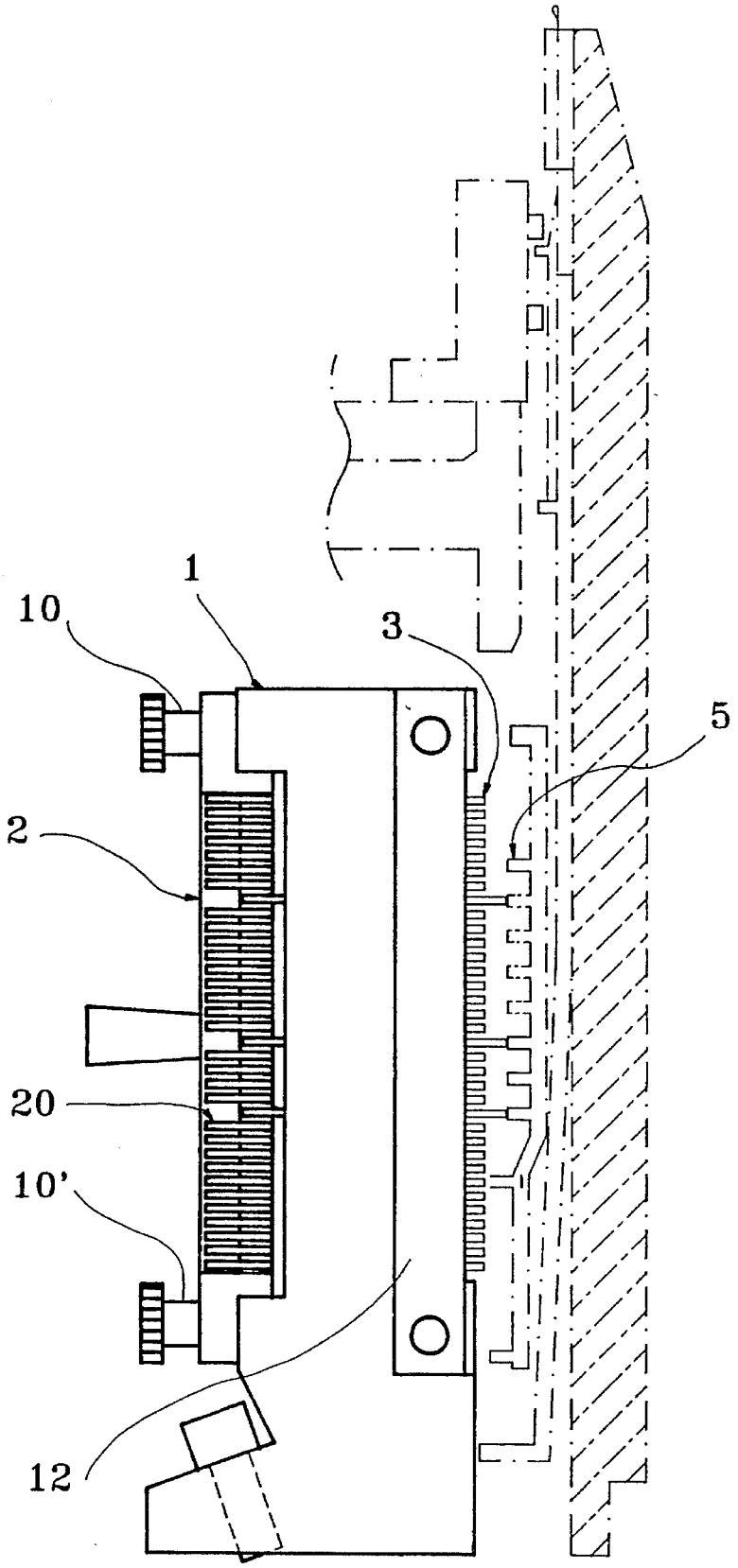
FIG. 7 is a schematic drawing showing the selecting mechanism installed in the circular knitting machine adjacent to the needle foot according to the present invention.

Referring to FIGS. 2 and 7, a selecting mechanism in accordance with the present invention comprises a base 1 mounted in a circular knitting machine near the needle foot 5, and a selecting jack pushing-up device 2 detachably fastened to the base 1 by screw bolts 10 and 10'.

Figure 4:
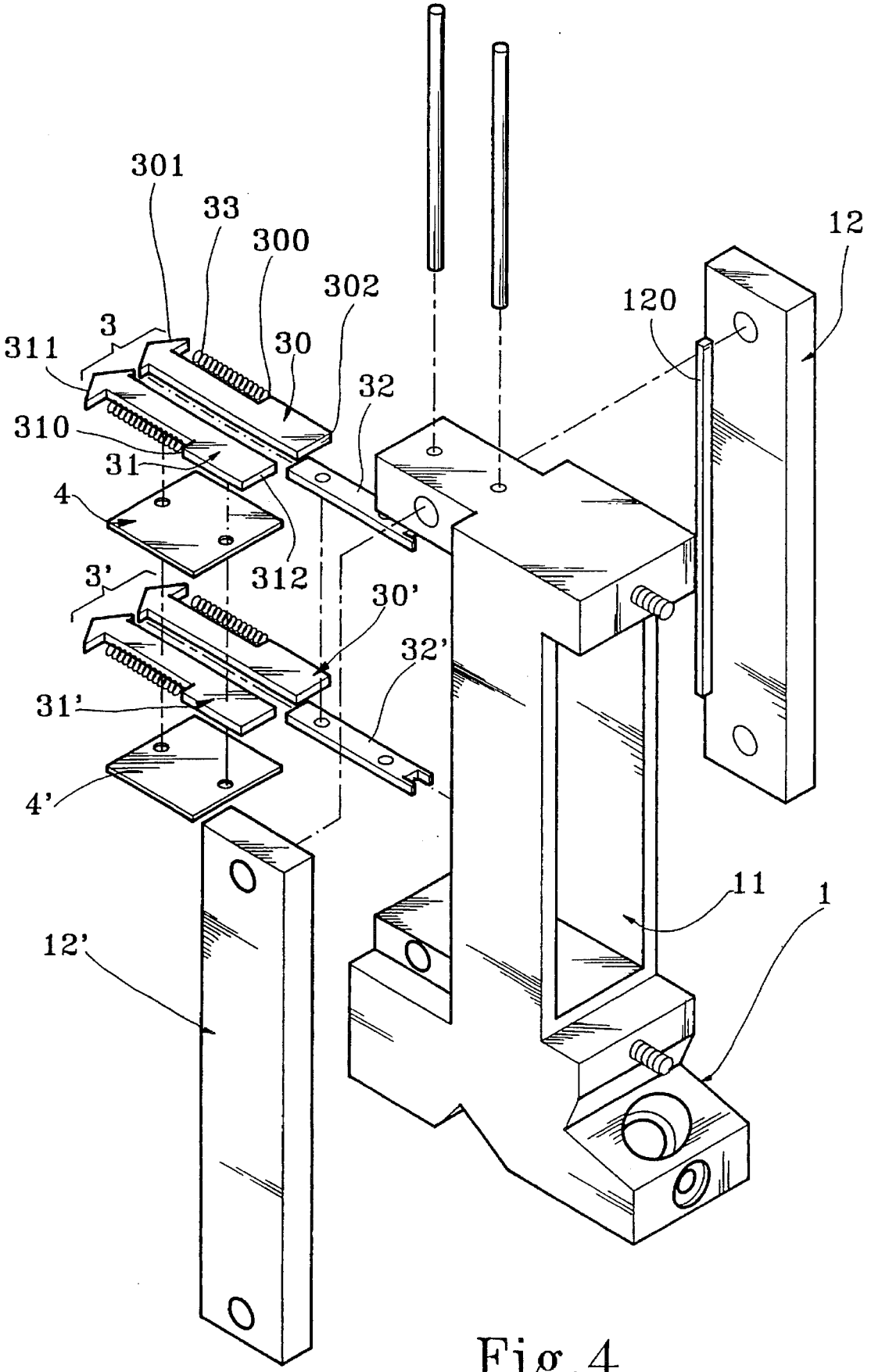
FIG. 4 is an exploded view of the base for the selecting mechanism according to the present invention.
Figure 5B:
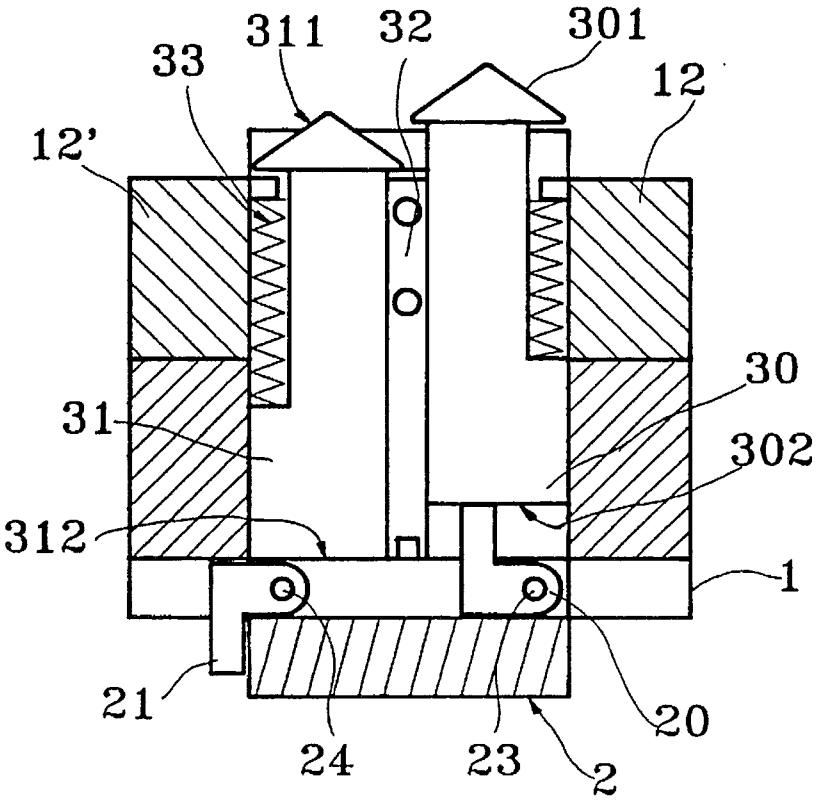
FIG. 5B is similar to FIG. 5A but showing the right-sided selecting jack set in the operative position and the left-sided selecting jack set in the non-operative position.
Figure 5A:
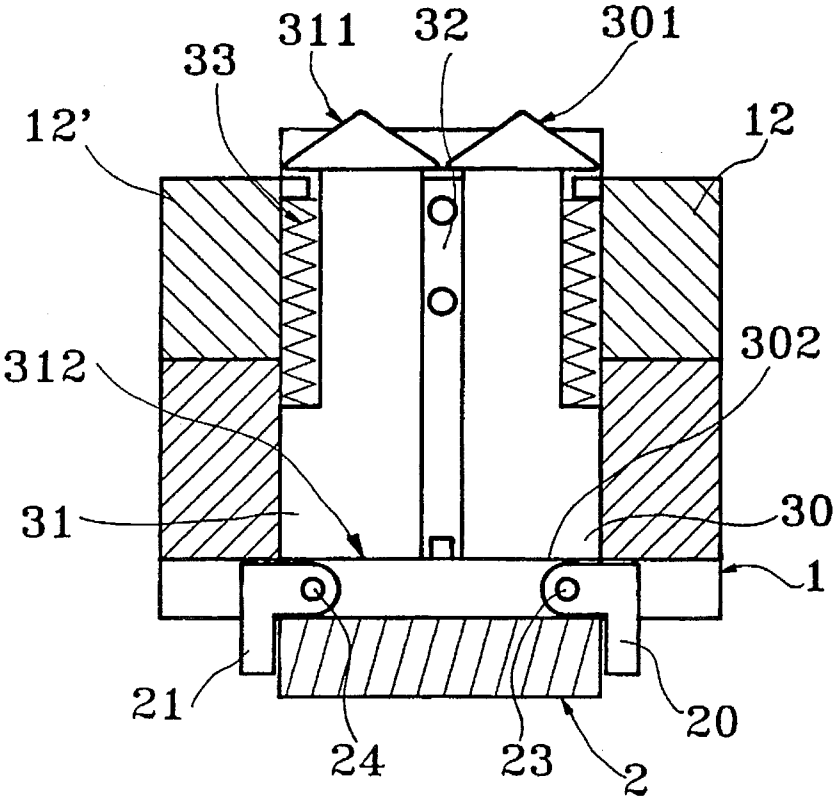
FIG. 5A is a sectional view of the base for the selecting mechanism according to the present invention, showing the two selecting jacks of the same pair set in the non-operative position.
Figure 5C:
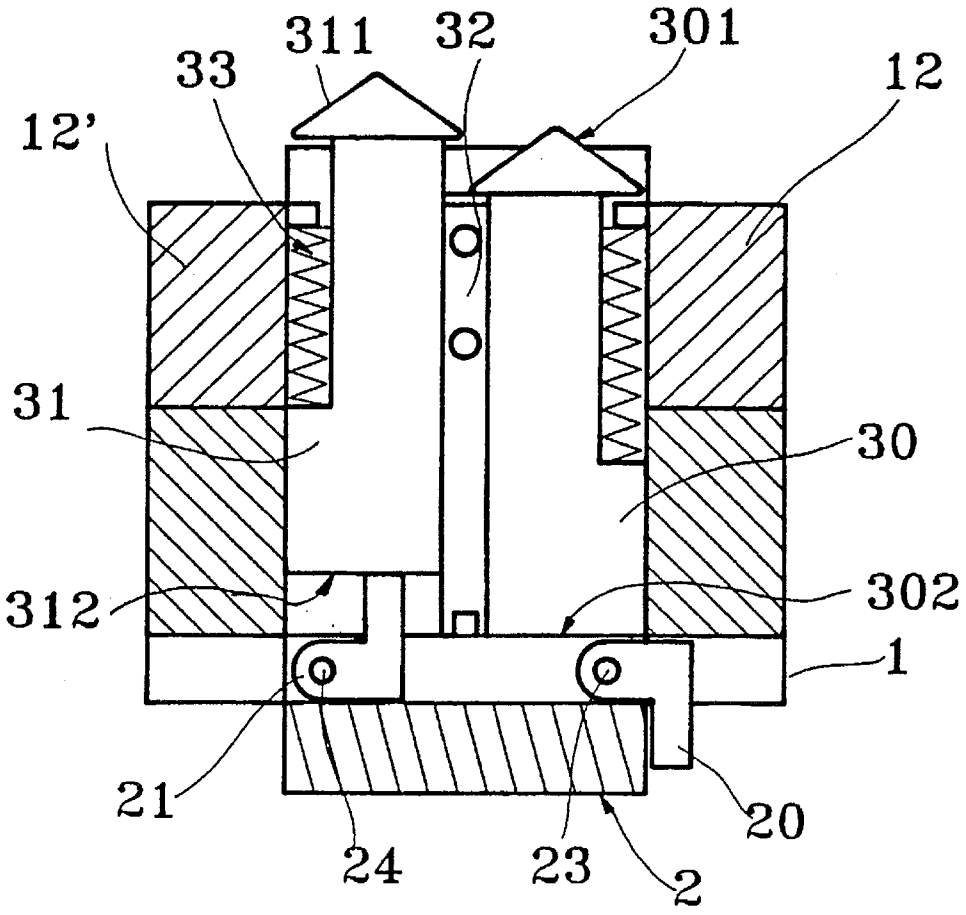
FIG. 5C is similar to FIG. 5A but showing the right-sided selecting jack set in the non-operative position and the left-sided selecting jack set in the operative position.

Referring to FIG. 4, the base 1 comprises a hollow upright frame 11, a plurality of selection units 3, 3' arranged in a stack within the hollow upright frame 11 corresponding to the needles 5 and separated from one another by cushions 4, 4', two pressure boards 12 and 12' bilaterally fastened to the hollow upright frame 11 at the front side. Each selection unit 3 or 3' comprises two parallel horizontal selecting jacks 30 and 31 and a parting plate 32 therebetween. The selecting jack 30 or 31 comprises a horizontal butt 300 or 310, a spring 33 having one end connected to the butt 300 or 310 and an opposite end stopped at an inward front rib 120 on one pressure board 12 or 12'. When assembled, the projecting front ends 301 and 311 of the two selecting jacks 30 and 31 of each selecting unit 3 or 3' are respectively stopped outside the pressure boards 12 and 12' (see FIG. 5A). When the butt 302 or 312 of one selecting jack 30 or 31 is pushed up, the projecting front end 301 or 311 of the respective selecting jack 30 or 31 is moved forwards (see FIGS. 5B and 5C). Therefore, by selectively setting the selecting jacks 30 and 31 of either selection unit 3 or 3' into any of the positions shown in FIGS. from 5A to 5C, a full-stitch, half-stitch, or plain-stitch is achieved.

Figure 3:
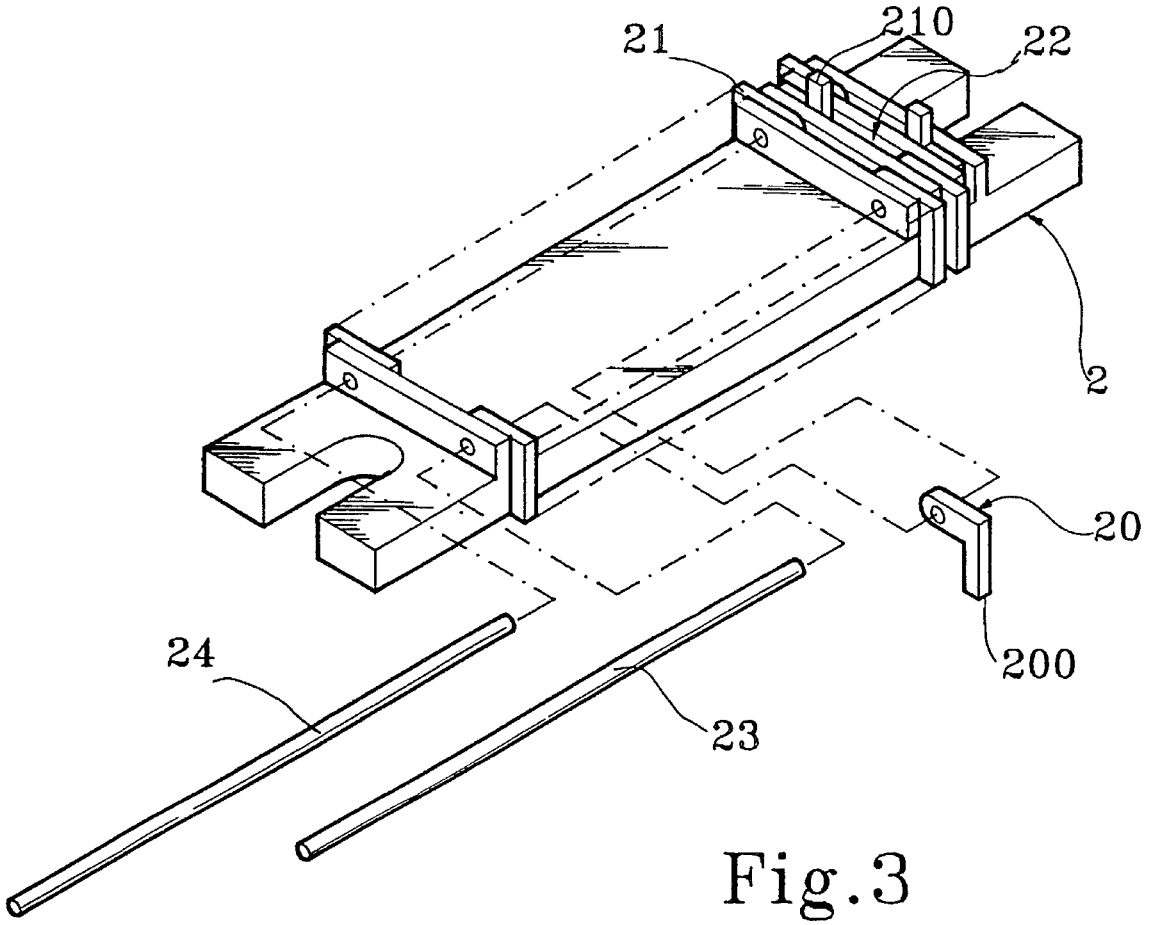
FIG. 3 is an exploded view of the selecting jack pushing-up device for the selecting mechanism according to the present invention.
Figure 6:
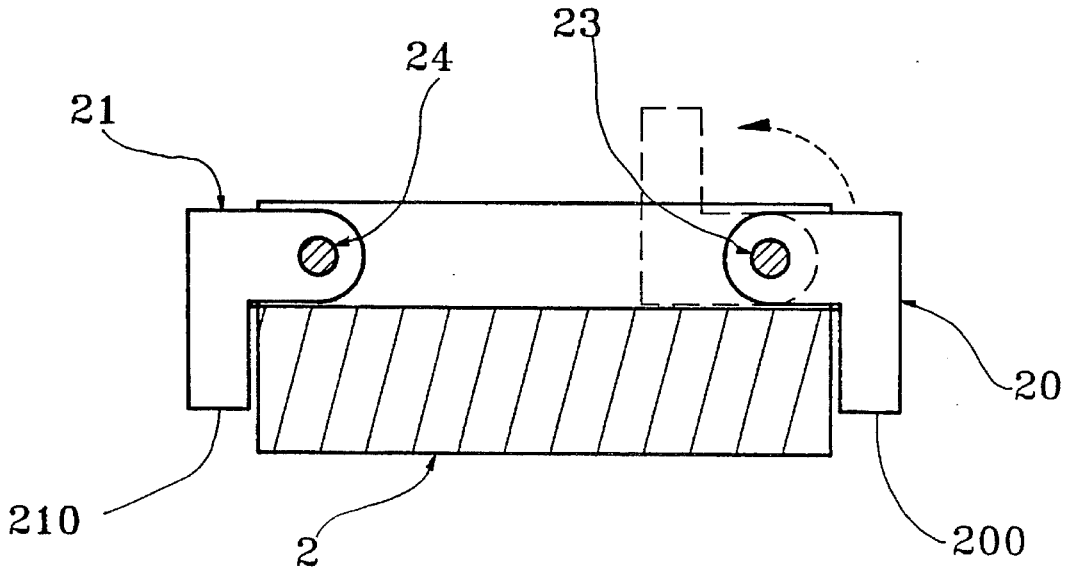
FIG. 6 is a cross sectional view of the selecting jack pushing-up device for the selecting mechanism according to the present invention, showing the turning angle of the pushing-up plates.

Referring to FIG. 3, the selecting jack pushing-up device 2 comprises a plurality of horizontal grooves 22 corresponding to the selection units 3, 3', pairs of pushing-up plates 20 and 21 respectively and bilaterally mounted in the horizontal grooves 22. Each pushing-up plate 20 or 21 has a nose 200 or 210 turned about a respective pivot 23 or 24 between the operative position (see the dotted line in FIG. 6) and the non-operative position (see the real line in FIG. 6). Therefore, the pushing-up plates 20 and 21 can be conveniently turned by fingers to the desired position without the use of any hand tools. When the pushing-up plates 20 and 21 are set, the selecting jack pushing-up device 2 is fastened to the base 1. When installed, the nose 200 or 210 which is set into the operative position forces the respective selecting jack 30 or 31 outwards, causing its projecting front end 301 or 311 reaches the needle foot 5.

I claim:

1. A selecting mechanism for a circular knitting machine, comprising a hollow base, a plurality of selection units arranged in a stack within said hollow base, each selection unit comprising two parallel selecting jacks, and a selecting jack pushing-up device fastened to said hollow base and selected to set said selecting jacks into an operative or non-operative position for a full-stitch, half-stitch, or plain-stitch operation, wherein said selecting jack pushing-up device comprises a plurality of horizontal grooves corresponding to said selection units, a plurality of pairs of pivotally mounted pushing-up plates respectively and bilaterally mounted in said horizontal grooves, each pushing-up plate having a nose portion, which when pivoted between a first position and a second position, moves the respective selecting jack to the operative or the operative position, and a second position, in which the respective selecting jack is moved to the non-operative position.

* * * * *